United States Patent [19]

Middleditch

[11] 4,385,229

[45] May 24, 1983

[54] SHEET COUNTING APPARATUS WITH TIME DELAY

[75] Inventor: Stanley W. Middleditch, Hayling Island, England

[73] Assignee: De La Rue Systems Limited, London, England

[21] Appl. No.: 167,205

[22] Filed: Jul. 9, 1980

[30] Foreign Application Priority Data

Jul. 13, 1979 [GB] United Kingdom ..... 7924468

[51] Int. Cl.[3] ..... G06M 9/02

[52] U.S. Cl. ..... 377/8; 271/95

[58] Field of Search ..... 235/92 SB, 92 FP, 98 B, 235/98 C; 271/95

[56] References Cited

U.S. PATENT DOCUMENTS

| | | | |
|---|---|---|---|
| 2,912,242 | 11/1959 | Richardson | 271/95 |
| 3,001,704 | 9/1961 | Lafaurie | 235/92 FP |
| 3,437,798 | 4/1969 | Stringer | 235/92 FP |
| 3,437,799 | 4/1969 | Upshur | 235/92 FP |
| 3,587,414 | 6/1971 | Rappaport | 235/92 SB |
| 4,064,391 | 12/1977 | Kokubo | 235/92 SB |

FOREIGN PATENT DOCUMENTS

| | | | |
|---|---|---|---|
| 787624 | 12/1957 | United Kingdom | 235/92 SB |
| 1243785 | 8/1971 | United Kingdom | 235/92 SB |
| 1410125 | 10/1975 | United Kingdom | 271/95 |

*Primary Examiner*—James D. Thomas
*Assistant Examiner*—James T. Beran
*Attorney, Agent, or Firm*—Frost & Jacobs

[57] ABSTRACT

The apparatus comprises a plurality of vacuum operated sheet moving organs mounted on a rotating counting disc which activates a counter each time a sheet is engaged by one of the sheet removing organs and moved from a first to a second position during the counting cycle, the counter actuating mechanism including a vacuum switch to inhibit the actuation of the counter if the vacuum to the sheet moving organs falls below a predetermined level due to the failure of the sheet moving organs to make proper contact with the sheets being counted, and a delay mechanism operative to prevent the vacuum switch from inhibiting actuation of the counter in the event of a momentary drop in the vacuum level upon improper initial contact of the sheet moving organs with the sheets but where proper contact is established before a predetermined position in the counting cycle is reached.

3 Claims, 7 Drawing Figures

12
C
BN'
BN
7
8
A
1
2
3
10
11
13
9
4
14
6
5
V
S2
S1

SHEET COUNTING APPARATUS WITH TIME DELAY

This invention relates to sheet counting apparatus of the type adapted to count the number of sheets contained in stack.

More specifically said apparatus, which is hereinafter referred to as "apparatus of the type described" comprises a support means for gripping one end of the stack, a driven rotatable sheet counting member carrying a plurality of contratrotatable sheet removing organs adapted to engage a side face of the free end of the stack while the sheets are in a first position and to move the sheets of the stack one at a time to a second position, means for applying vacuum sequentially to said sheet removing organs as the sheet counting member rotates and a sheet counter for counting sheets moved to said second position.

BACKGROUNDS OF THE INVENTION

There are two well established methods of effecting the counting of sheets moved by the above described apparatus. In one known method a pressure-sensitive counting device is provided in the vacuum supply line between a source of suction and the port faces of the vacuum sheet removing organs. For example, a diaphragm or bellows type device in communication with a vacuum supply line may be arranged to generate count pulses in accordance with pulsations of vacuum level created during the transference of the sheets. It will be appreciated that in this arrangement it will be of no consequence to the counting operation if a suction organ fails to remove a sheet during a counting operation.

The second known method, which is relevant to the present invention, involved theuse of a holding circuit which is maintained by a pressure-sensitive switch disposed in the vacuum supply line. Such a system is disclosed in U.S. Pat. No. 2,912,242 and which includes, inter alia, a means for generating count pulses and for counting the same upon the rotation of the rotary assembly, in conjunction with a pressure-sensitive switch which is arranged to arrest operation of the apparatus and to inhibit counting if the level of vacuum falls below a predetermined value. This arrangement necessitates the provision of means for correctly aligning a suction organ with respect to the stack prior to counting but offers certain advantages over the above-mentioned first method of counting and insures that the machine cannot operate at an inadequate suction level.

Thus the second method effectively serves to prevent the creation of a spurious count pulse by the passage of a suction organ not carrying a sheet and is perfectly satisfactory when used in conjunction with normal grades of paper. However, we have found in practice that when handling banknotes of an unusual nature, for example banknotes made from relatively stiff grade of paper, or badly crumpled, worn or distorted banknotes, that occassions arise when the vacuum level falls below the said predetermined value in spite of the fact that the banknote is correctly transferred by a sheet removing organ. Such an occurence simulates the condition of the passage of a suction organ not carrying a banknote and therefore arrests operation of the apparatus. We have ascertained that the loss of vacuum level is attributable to the delay in the initial sealing of the port face of a suction organ by a banknote, i.e. during the commencement of a banknote feeding cycle. Accordingly, the aim of the present invention is to overcome inhibition of the apparatus during a counting operation while still retaining the advantages of the holding-circuit method.

SUMMARY OF THE INVENTION

According to the present invention there is provided sheet counting apparatus of the type described in which a vacuum switch is provided sensitive to the level of vacuum attained within said sheet removing organs, said vacuum switch being adapted to inhibit operation of said sheet counting member and sheet counter upon the attainment of vacuum less than predetermined value, wherein a delay means is provided to prevent said vacuum switch means from inhibiting operation of the sheet counting member and sheet counter during a predetermined first part of each sheet removing cycle even though the vacuum falls below said predetermined level until the respective suction organ reaches a selected position.

The vacuum switch means may be of any convenient type provided that it is capable of responding to a rapid change of vacuum level and of electrically switching a solenoid-operated vacuum control valve, the driving motor of the sheet counting member and, optionally also, of providing other inhibit and/or warning control signals. The sensor component of the switch may comprise a moveable piston, a bellows or a flexible diaphragm and the transducing component thereof may comprise one or more pairs of electrical contacts, a transducer adapted to provide an electrical output in dependence on change of capacitance or magnetic effect, or a piezo-electric or strain gauge type device. Furthermore, the output of the switch may be arranged to control the driving motor either directly, or via relay or solid state switching devices, with or without amplification.

The delay may be effected by electromechanical, optical or electronic means which may be actuable upon rotation of the sheet counting member or its associated drive means, or alternatively by a time controlled delay means.

From another aspect the invention comprises a sheet counting apparatus adapted to count the number of sheets in a stack, the apparatus comprising a drive means to drive a number of suction organs adapted to be sequentially connected to a vacuum source and contact successive sheets in the stack to move the sheets from a first position to a second position:

means to operate a sheet counter to record the movement of each sheet, means to inhibit the operation of the drive means and the sheet counter if the vacuum in a respective suction organ falls below a predetermined level, and means to delay the inhibiting effect of the vacuum dropping below said predetermined level.

BRIEF DESCRIPTION OF THE DRAWINGS

An embodiment of a sheet counting apparatus, adapted to count banknotes, will now be described, by way of example, with reference to the accompanying drawings in which.

DETAILED DESCRIPTION

Figures 1A, 1B, 1C, 1D:
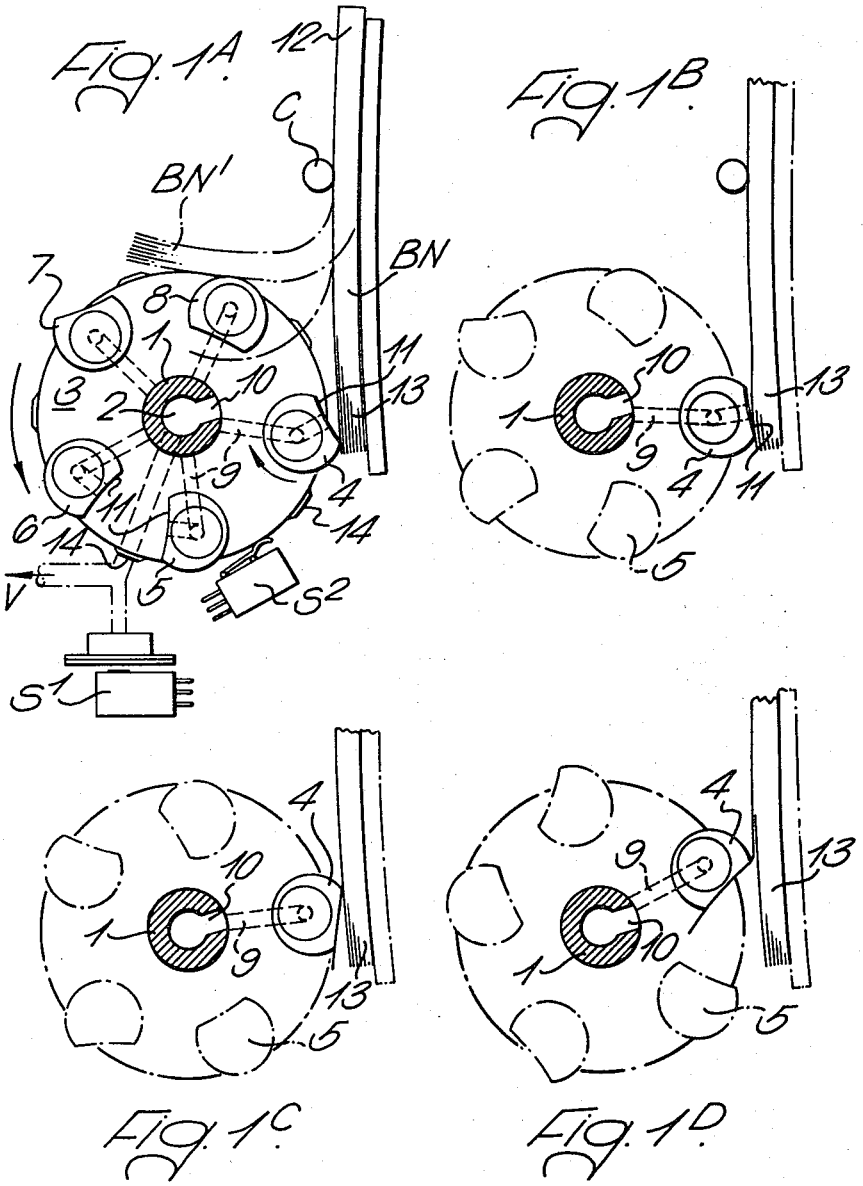
FIG. 1A shows in diagrammatic form the essential components of a sheet counting apparatus.
FIGS. 1B to 1D illustrate various sequential stages of operation of the apparatus.

The sheet counting apparatus comprises a vertical stationary stub shaft 1 the lower end of which is rigidly attached to a base plate (not shown). The shaft 1 is provided with an axial bore 2 which is connected by tubing to a source of vacuum V and a diaphragm type vacuum-sensitive switch $S^1$ which is adapted to close electrical contacts when a vacuum level of approximately 18" Hg is obtained and to open same when a low threshold level of 15" Hg is obtained.

Disposed upon the shaft 1 is a rotatable sheet counting member comprising a disc member 3 on which is mounted five vertically arranged rotatable sheet removing organs 4–8. The disc 3 is driven in an coubterclockwise direction by driving means of the kind illustrated and fully described in U.S. Pat. No. 2,912,242 in which the sheet removing organs are driven in a clockwise direction by means of planetary gearing which includes a stationary internally-toothed gear ring and a pinion secured to each sheet removing organ respectively.

Radial bores 9 (i.e. one for each sheet removing organ) are provided in the disc member 3 which sequentially align with a distribution port 10 formed in the shaft 1, and create a vacuum at concave sheet-engaging port faces 11 of the sheet removing organs via a succession of internal conduits. Thus, with vacuum in the system, as the disc 3 rotates, the radial bores sequentially align with the distribution port 10 and vacuum is applied to the port faces 11 of the sheet removing organs during a predetermined and controlled angle of rotation shown in FIG. 3 as 72°.

A stack of banknotes BN is gripped at one end 12 by a clamping means C and the free end 13 of the stack is presented to the port faces 11 of the sheet removing organs in the manner shown. In operation, the free ends of the banknotes are conveyed one at a time by the rotation of the sheet removing organs to reform the end of the stack at $BN^1$. During the transfer of the banknotes vacuum is maintained at a level of approximately 24" Hg and rotation of the assembly is arranged to advance a counter unit one digit each time a port face 11 completes the predetermined 72° of rotation. After the last banknote of the stack has been conveyed atmospheric air enters the port face of the following sheet removing organ, the vacuum level falls below 15" Hg and the switch $S^1$ deenergizes the driving motor thereby to arrest the apparatus. If at any time during a counting operation a sheet removing organ fails to convey, or fails to make an efficient pneumatic seal with a banknote, the vacuum level falls and the apparatus is arrested in a similar manner. However, in this instance the count is incomplete and a warning signal is generated.

Figure 2:
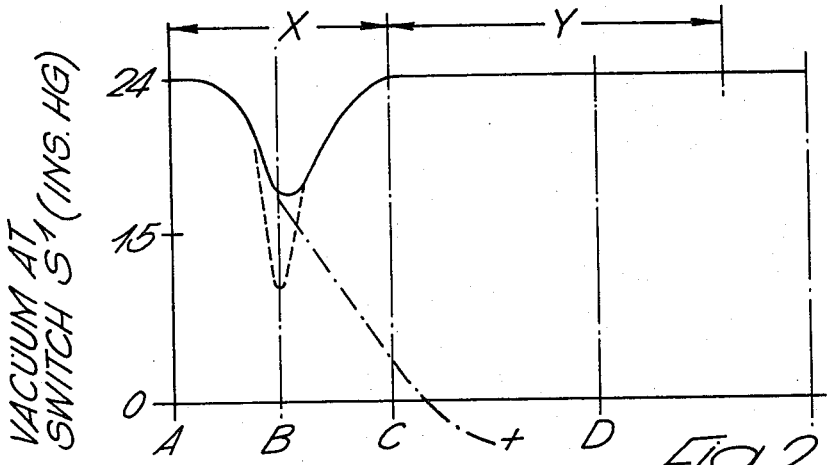
FIG. 2 is a graphical representation of one complete sheet counting sequence plotted against vaccum level.
Figure 3:
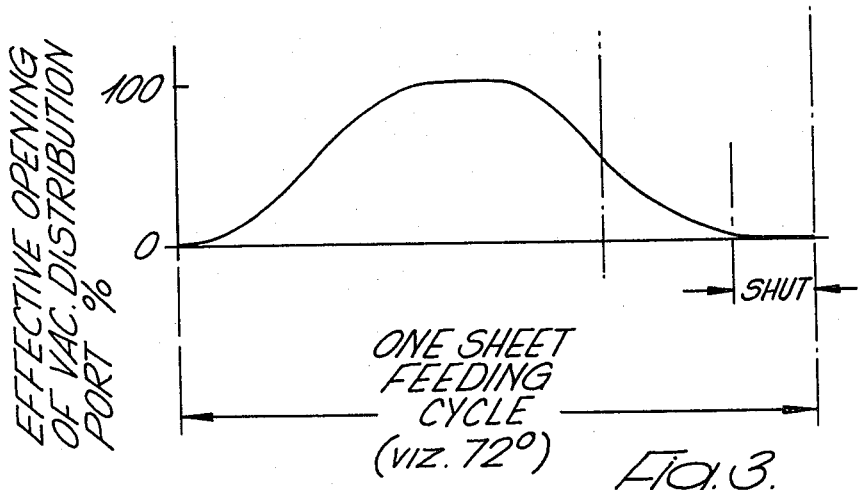
FIG. 3 is a graph illustrating the effective opening of the vacuum distribution port during the same counting sequences as that shown in FIG. 2.

Referring now to the four sequential operative stages in FIGS. 1A to 1D, and to the graphs in FIGS. 2 and 3, in operational stage FIG. 1A vacuum is completely cut-off because the distribution port 10 of the shaft is obstructed by the bore of the disc 3, and thus a maximum level of 24"Hg is obtained in the switch $S^1$. Counterclockwise rotation of the disc 3 (and hence clockwise rotation of the sheet removing organ 4) starts admission of vaccum to the port face of 4, see FIG. 1B, and because the face has not fully sealed with the first banknote of the stack there is a momentary loss of vacuum level (see solid line on the graph) to approximately 17" Hg.

In the operational stage illustrated by FIG. 1C the conduit 9 is fully open with respect to the distribution port 10 and the enhanced throughput of air causes the banknote to adhere to the port face and hence the vacuum level rises again to 24" Hg.

In the final operational stage illustrated in FIG. 1D the end of the first banknote is turned from the stack and the vacuum is maintained. Thereafter the vacuum will be gradually cut-off at the distribution port 10 and the banknote released. However, the banknote will be prevented from returning to the stack face by the following sheet removing organ 5, and thus is irreversibly conveyed to the delivery position $BN^1$. During the period that the banknote is being conveyed a count pulse is produced and recorded on a digital counter.

The above sequence relates to the handling of a banknote of average quality and condition and from the graph in FIG. 2 it will be appreciated the vacuum level has not reached the low threshold value of 15" Hg.

As previously mentioned, occasions arise when it is necessary to handle relatively stiff or distorted banknotes and accordingly it is not unusual for one or more of such banknotes in a batch to present a problem with respect to obtaining a rapid and efficient air seal to the portface of a sheet removing organ. Thus it is possible for the vacuum level to fall momentarily below the predetermined threshold of 15" Hg during the sequential operational stage as shown in FIG. 1B, with a consequential stoppage of the apparatus in spite of a satisfactory conveyance of the offending banknote (see dotted line on the graph).

In accordance with the present invention a delay means is provided which effectively serves to enable the vacuum sensitive switch $S^1$ to ignore vacuum levels falling below the stated threshold during the period X. Thus when a banknote has progressed beyond the stage illustrated in FIG. 1C there is little likelihood that it will fall back on the stack face through poor adhesion and accordingly a count pulse is generated during the period Y.

In a first example of a delay means a micro-switch $S^2$ is secured to the framework of the apparatus and is adapted for operation by five switch cams 14 angularly disposed upon the rotary disc. The cams are phased in such a manner that the contacts of the vacuum switch $S^1$ are only effective during a period within Y (see the graph in FIG. 2). Normally-open or normally-closed switches may be employed in conjunction with negative or positive cams. Alternatively, a photo-electric or proximity switching means may be provided instead of the micro-switch $S^2$.

As a further alternative the delay may be effected by means of a counting device adapted to count time clock pulses from each of five datum positions associated with the disc member 3. Alternatively again, a circumferentially perforated wheel may be mounted on the disc member or on the drive means therefore, and adapted to provide angular-position count pulses from a photoelectric sensor.

Thus it will be seen that by means of the above described invention, unnecessary stoppage of the apparatus is eliminated in instances of slow initial sealing of certain difficult banknotes, but of course the safety of the know art holding-circuit system is retained and if a sheet removing organ fails to pick up a banknote the vaccum level will fall off and remain below the threshold level (see chain-dotted line in FIG. 2) and further operation of the apparatus will be inhibited. It should be noted that in actual practice the vacuum switch also actuates a change-over air valve which serves to cut off vacuum and apply air at positive pressure to the sheet removing organ to prevent the risk of banknote "carry over" during batching operations.

Figure 4:
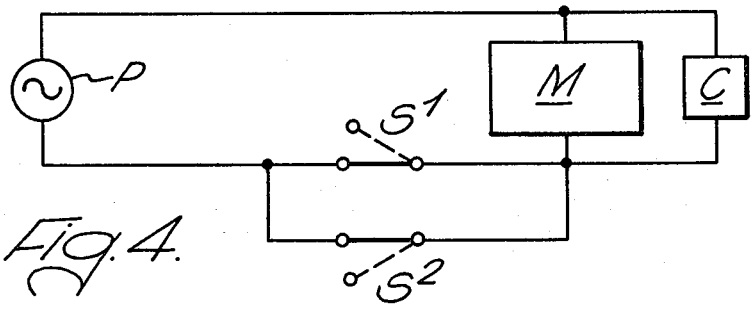
FIG. 4 illustrates a simplified circuit diagram of the electrical operation involved.

FIG. 4 illustrates the electrical operation of the apparatus. It will be seen that switches $S^1$ and $S^2$ are in parallel in a line joining a source of power P to the driving motor M and counter C. $S^1$ and $S^2$ are both normally closed and are in parallel in the power line to both motor M and counter C. If $S^1$ opens due to a fall in the vacuum level M and C will not be inhibited until $S^2$ also opens i.e. during a portion of period Y.

The counter is not illustrated in detail since it may be of the kind described and illustrated in the aforementioned U.S. Pat. No. 2,912,242. Alternatively, a simple LED senser device may be used in which five 'flags', one for each suction organ, are mounted on the periphery of disc member 3 and pass between the emitter and receiver of the sensor.

I claim:

1. In a counting apparatus for counting the number of sheets of paper in a stack, the apparatus comprising a rotatable counting disc mounting a plurality of suction organs adapted to be sequentially connected to a vacuum source during a counting cycle wherein the suction organs contact successive sheets in the stack adjacent the ends of the sheets and move said ends from a first position to a second position, a counter actuated by the counting disc for counting the sheets as they are moved to said second position, and a vacuum switch connected to the vacuum source and to the counter to inhibit operation of the counter when the vacuum drawn on the suction organs falls below a predetermined value, the improvement which comprises a delay means connected to the counter to prevent the vacuum switch from inhibiting operation of the counter during the first portion of each sheet counting cycle even though the vacuum falls below the predetermined value during the first portion of the sheet counting cycle.

2. The counting apparatus according to claim 1 wherein said delay means comprises a time delay switch connected in parallel with the vacuum switch and arranged to override the inhibiting effect of the vacuum switch during the first portion of each sheet counting cycle.

3. The sheet counting apparatus according to claim 2 in which said time delay switch is operated by cam means rotatable with said rotatable sheet counting disc, said cam means being positioned to operate said time delay switch at the end of the first portion of each sheet counting cycle.

* * * * *